US005253865A

United States Patent [19]

Kinnee

[11] Patent Number: 5,253,865

[45] Date of Patent: Oct. 19, 1993

[54] SAFETY BALL HAVING A CLOTH COVER WITH A FLAT-STITCHED SEAM AND METHOD

[75] Inventor: Bruce E. Kinnee, San Ramon, Calif.

[73] Assignee: Easton Sports, Inc., Burlingame, Calif.

[21] Appl. No.: 893,497

[22] Filed: Jun. 4, 1992

[51] Int. Cl.[5] ..... A63B 37/12

[52] U.S. Cl. ..... 273/60 A; 273/58 A

[58] Field of Search ..... 273/58 RA, 60 R, 60 A, 273/60 B, 65 EB, 65 EG, 58 K

[56] References Cited

U.S. PATENT DOCUMENTS

| | | | |
|---|---|---|---|
| 1,668,969 | 5/1928 | Maynard | 273/60 A |
| 1,861,157 | 5/1932 | Grady | 273/60 A |
| 1,994,703 | 3/1935 | Hawes | 273/60 A |
| 2,006,861 | 7/1935 | Grady | 273/60 A |
| 4,462,589 | 7/1984 | Morgan | 273/60 R |
| 4,772,019 | 9/1988 | Morgan | 273/60 B |

*Primary Examiner*—V. Millin
*Assistant Examiner*—Steven B. Wong
*Attorney, Agent, or Firm*—Flehr, Hohbach, Test, Albritton & Herbert

[57] ABSTRACT

A safety game ball (21) with a cloth cover (23) having a flat stitched seam (31) and method of manufacturing the same. The safety game ball (21) includes a spherical core (22) formed of an elastically-deformable material, a flexible cloth cover (23) mounted over and enclosing the core (22) and having cover edges (28, 29) juxtaposed along a circumferentially-extending butt seam (31). An edge binding assembly (32) including a cloth-edge reinforcing strip (33) and a plurality of binding stitches (34) closely proximate to each of the edges (28, 29) is provided, and a plurality of seam stitches (36, 36a) extend from a position (37) inwardly of the edge binding assembly (32) on one side of the seam (31) to a position (38) inwardly of the edge binding assembly (32) on the other side of the seam (31).

18 Claims, 2 Drawing Sheets

SAFETY BALL HAVING A CLOTH COVER WITH A FLAT-STITCHED SEAM AND METHOD

TECHNICAL FIELD

The present invention relates, in general, to game balls such as baseballs, softballs and the like, and more particularly, relates to safety game balls having a relatively low impact pressure.

BACKGROUND ART

About ten years ago, a new category of game balls came into existence, namely, the safety game ball and particularly the safety baseball and the safety softball. These game balls are formed with polyurethane foam cores that are covered with a cloth cover having stitched seams. The primary feature of these balls is that they have a play value, performance, which approximates in many respects the performance of standard or regulation balls, but they produce an impact pressure when they hit players which is far less than the much harder regulation balls. U.S. Pat. Nos. 4,462,589 and 4,772,019 describe in detail these safety baseballs.

Safety baseballs are now being used by twenty-two of the twenty-six major league baseball teams as training tools. Similarly, many colleges, high schools and Little League teams use safety baseballs for training purposes. Safety baseballs also have been approved for use in T-Ball leagues as a game ball by Little League Baseball, Pony League Baseball, Dixie Youth Baseball and National Youth Sports Coaches Association. The present market for safety, and other resilient core, baseballs and softballs is estimated to be between 3 to 4 million units per year.

One of the drawbacks of the cloth-covered, safety game ball has been that the seams are not herringbone, flat-stitched seams. Cloth-covered safety game balls have been constructed with seams that are formed by cover edges which are pulled together and extend outwardly in a side-by-side relationship from the ball and are joined by loop-type stitching. Such raised, loop-stitched seams, however, have the aesthetic and psychological disadvantage of not having the same appearance as a regulation baseball or softball. Thus, for the "traditionalist" the non-regulation appearance of the ball outweighs the safety benefits. This has caused the safety balls to be used primarily in practice or non-competitive situations at higher levels of play, although the balls are used competitively in T-ball leagues, as indicated above.

Regulation baseballs and softballs have relatively flat seams in which the stitching is laid out in a herringbone pattern. The seam can be felt to be slightly raised relative to the remainder of the ball, but as compared to a safety baseball with its looped-stitched and outwardly-protruding seams, the regulation balls have flat or co-spherical seams with respect to the body of the balls.

The primary reason for the safety baseball protruding seam construction is that it is necessary in terms of safety to have an elastically-resilient core capable of substantial deformation. This elastic deformation of the core greatly reduces the impact pressure in the event that the ball hits a player. Moreover, the use of a cloth cover, as opposed to a regulation leather cover or a vinyl cover, further ensures low impact pressures by not materially contributing to the ball's hardness.

When a safety baseball is stitched with a conventional herringbone seam, however, the substantial deformation of the core causes the stitching to rip the cloth cover at the seams during the high energy impact with a bat. Thus, safety baseballs with flat, herringbone-stitched, seams have been found to have very poor durability.

Nevertheless, the pressure to eliminate the protruding loop-stitched seams of the safety baseball has remained. One solution has been to substitute a vinyl cover for the cloth cover. When a vinyl cover is used on a safety baseball core, the result is a game ball having lower impact pressure than a regulation ball, but such vinyl covered balls still have an impact pressure which is at least twice as high as a clothcovered ball. Thus, a substantial safety sacrifice is made when using a vinyl cover to obtain the appearance of herringbone stitching and flat seams. Nevertheless, in the safety baseball category, the current largest growth product is the vinyl covered ball, simply because it looks more like a regulation baseball.

There also have been leather-covered resilient, urethane foam core baseballs with flat-stitched, herringbone seams, but these balls have an even higher impact pressure which takes them out of the safety category.

Various other attempts have been made to provide a cloth-covered safety game ball with flat, herringbone-stitched seams. The edges of the cloth cover pieces have been seared or melted to form a ridge along the edges to try to prevent tearing at the seams during play. The result has been that the cloth covers continued to tear and the hard ridges along the seam were a safety concern. Additionally, a vinyl gasket has been adhered to the outer edge of a cloth cover and herringbone stitching used. The result was that seam tearing was reduced, but the nylon cloth cover and vinyl strip tended to delaminate, and the vinyl material formed a hard ridge along the seam that created a new safety hazard.

Accordingly, notwithstanding the widely recognized benefits of the safety game ball there has remained the constant appearance disadvantage of the protruding, loop-stitched seam. Essentially, this problem has relegated the safety game ball primarily to practice and training situations at higher skill levels and Tball in younger leagues and has produced a compromise game ball having a vinyl cover and resultant impact pressure that is undesirably high.

DISCLOSURE OF THE INVENTION

Accordingly, it is an object of the present invention to provide a safety game ball having a cloth cover with flat, herringbone-stitched seams that is durable and yet remains safe.

Another object of the present invention is to provide a safety baseball with a cloth cover and herringbone-stitched seams and an impact pressure far below that of a regulation baseball.

The safety game ball of the present invention has other objects and features of advantage which will become apparent from, and/or are set forth in more detail in the accompanying drawing and the following description of the Best Mode of Carrying Out the Invention.

The safety game ball of the present invention comprises, briefly, a substantially spherical core formed of an elastically-deformable material, such as a foamed urethane, and a flexible cloth cover, preferably a knit nylon, mounted around and enclosing the core. The cover has opposed cover edges juxtaposed together along a circumferentially-extending butt seam and an edge binding structure including a cloth-edge reinforcing strip and a plurality of binding stitches closely proximate each of the cover edges and securing the cloth-reinforcing strip to the cover proximate the edges. A plurality of seam stitches, preferably in a herringbone pattern, extend across the flat butt seam from a position inwardly of the binding stitches and cloth-edge reinforcing strip on one of the cover edges to a position inwardly of the binding stitches and cloth-reinforcing strip on the other of the edges.

THE BEST MODE OF CARRYING OUT THE INVENTION

The safety game ball of the present invention is particularly well-suited as an alternative to game balls which are relatively hard and can cause injury to players. Thus, regulation baseballs and regulation softballs (11 inch, 12 inch and 16 inch) are all sufficiently hard to cause injury, and even death, as a result of impact with a player. Other sports also employ very hard game balls, and the safety game ball of the present invention is also well-suited for those applications.

For simplicity of description, the safety game ball of the present invention will be described in connection with a regulation size baseball, but it will be understood that virtually all of the advantages are present in other forms and sizes of game balls, and particularly 11 and 12 inch circumference softballs.

Figure 1:
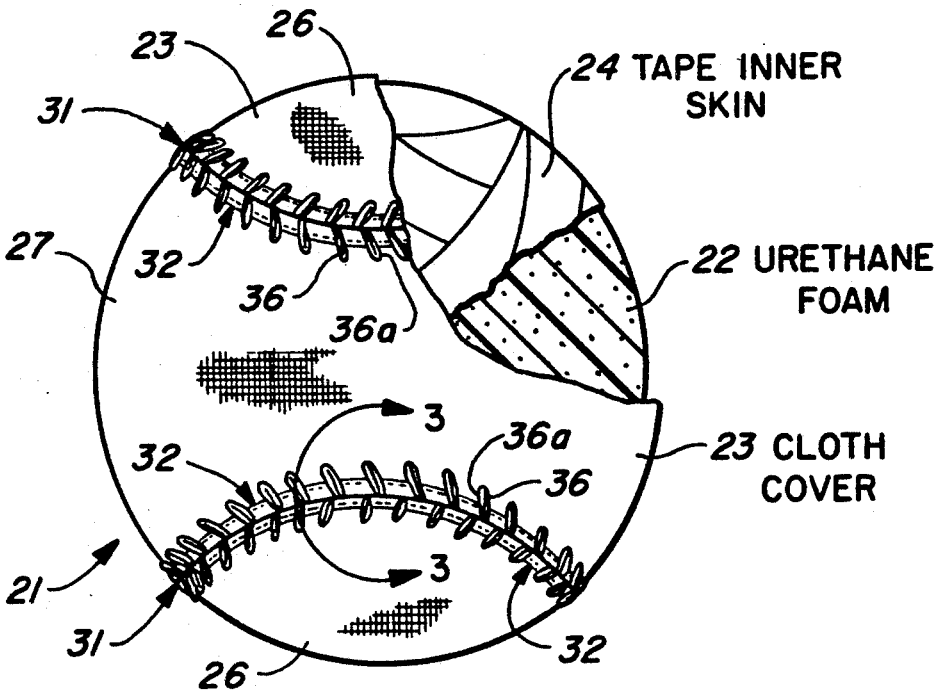
FIG. 1 is a front elevation view, partially broken away, of a safety game ball constructed in accordance with the present invention.

Referring now to FIG. 1, the safety baseball of the present invention, generally designated 21, can be seen to be formed with a substantially spherical elastically-deformable core 22, which is preferably a resilient, relatively soft, closed-cell polyurethane foam. Other core materials can be employed, as long as they are sufficiently deformable so as to substantially reduce the impact pressure of the ball when it hits a player as compared to hard core regulation balls. Core 22 of the present invention can be formed as described in more detail in U.S. Pat. Nos. 4,462,589 and 4,772,019. It will be understood that it is contemplated in the present invention that the core weight and size can be varied from those disclosed in such patents, but the descriptions in U.S. Pat. Nos. 4,462,589 and 4,772,019 relating to the urethane foam cores are incorporated herein by reference.

Mounted over elastically-deformable core 22 is a flexible cloth cover 23. The cloth cover is preferably provided by a knit nylon. Again, other cloth, fabrics or other can be employed, as long as they do not significantly increase the resultant impact pressure of composite game ball 21.

Additionally, in order to enhance the resistance of the game ball to the absorption of moisture and increase the core durability, the game ball may be formed with a flexible inner skin 24. A cloth-based adhesive tape may be wound around core 22 to provide inner skin 24 before mounting cover 23 on the ball. Inner skin 24, however, is optional, and also can be formed by simply sealing urethane foam core 22. Again, inner skin 24 should not significantly increase the impact pressure produced by the game ball.

In U.S. Pat. No. 4,462,589, the degree of resiliency and elastic deformation of the safety game ball was expressed in terms of durometer of the composite ball. It has been found through subsequent testing that a more meaningful comparative measurement of the safety may be to measure the impact pressure produced by the ball. The impact of a game ball may be recorded on a pressure-sensitive recording film. Fuji Corporation of Japan markets a series of four sensitivity levels of pressure-sensitive film. The most sensitive level is known as "SuperLow" and is well-suited for use to compare the impact pressure of various game balls.

A game ball may be launched by a pitching machine or ball cannon and impacted at various velocities against a Fuji SuperLow pressure-sensitive films which is supported on a vertical, flat concrete wall. The maximum impact pressure is determined by using a calibrated color scale provided by the manufacturer. The recorded impact on the film at the center of the impact imprint is compared against the calibrated color scale to determine the maximum impact pressure of the ball.

A regulation Little League baseball (142 grams) impacting at a velocity of 30 miles per hour will have a maximum impact pressure of about 410 to 415 pounds per square inch. A vinyl-covered safety game ball with the same weight as a regulation baseball will have a maximum impact pressure at the same velocity of about 360 to 365 pounds per square inch. A vinyl covered safety baseball having a weight of 110 grams (32 grams less than a regulation baseball) will have an impact pressure at 30 miles per hour of about 195 to 200 pounds per square inch. A safety baseball weighing 100 grams with a cloth cover will have a maximum impact pressure of about 110 to 120 pounds per square inch at 30 miles per hour.

The regulation Little League ball, therefore, has an impact pressure which is approximately four times that of a safety baseball constructed in accordance with U.S. Pat. No. 4,462,589.

It is believed that significant safety advantages will accrue if the impact pressure is below about 250 pounds per square inch for a 30 mile per hour impact and most preferably the safety game balls of the present invention have an impact pressure of about 200 pounds per square inch or less.

There is no doubt that a cloth-covered resiliently-deformable foam game ball will be significantly safer to use than either a regulation Little League ball or a vinyl-covered ball. In terms of rebound, as measured by dropping each ball from 12 feet onto a flat concrete surface, the safety baseball of U.S. Pat. No. 4,462,589 has a rebound of 98 percent of that of a regulation Little League and the vinyl-covered ball has a rebound of 97 percent of the regulation Little League ball.

As above set forth, considerable effort has been undertaken to devise a cloth-covered safety baseball with conventional herringbone-stitched seams. The high deformation of the cores which produce low impact pressures produce corresponding substantial cover deformations that stress cover seams. The leather, polyurethane and vinyl-covered balls essentially compromise safety to achieve sufficient cover strength (a reduction in deformation) to enable herringbone-stitched butt seams. The ball of the present invention provides a cloth-covered safety baseball with flat, herringbone-stitched seams that has a durability and safety which is equal to the durability and safety of cloth-covered balls having protruding, looped seams.

Figure 2:
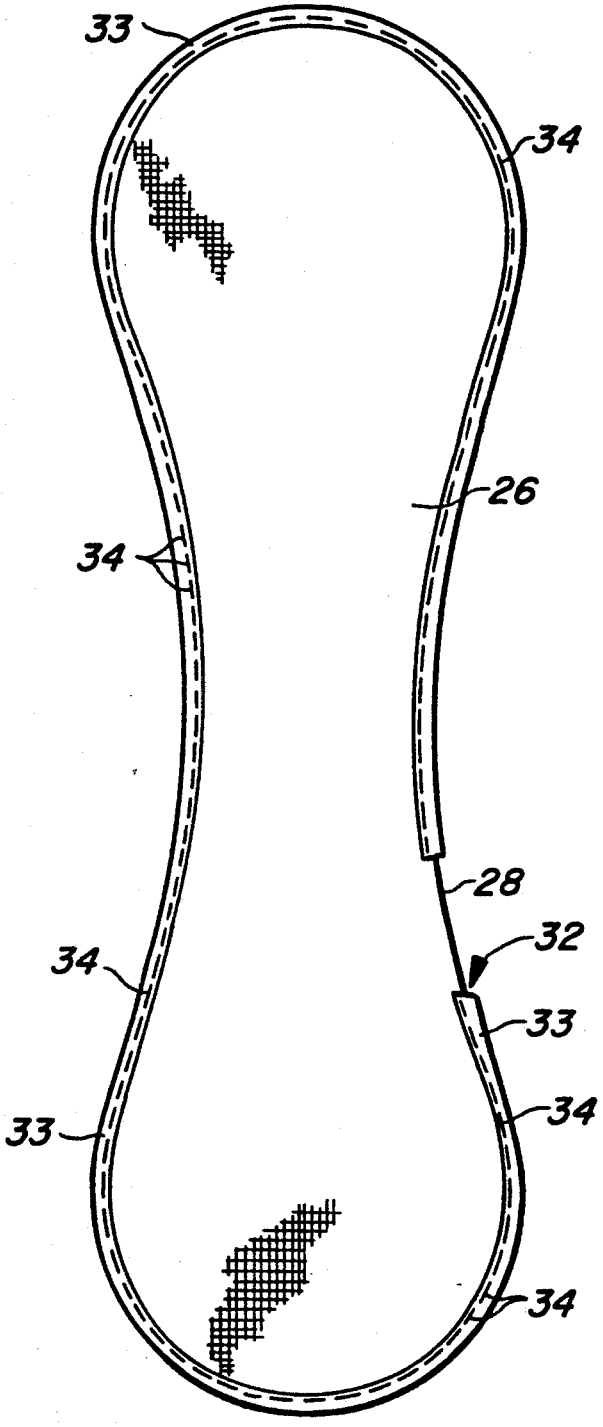
FIG. 2 is a top plan view of one cloth cover piece used to form the safety game ball of FIG. 1.

FIG. 2 illustrates one of the peanut-shaped cover pieces 26 which is typically used to form the cover of a baseball or softball, whether the cover is leather, vinyl or cloth. If cloth cover member 26 is wrapped in a general vertical orientation about core 22, a second similarly peanut-shaped, cloth cover member 27 can be wrapped horizontally around core 22, with the result that cover edge 28 on cover member 26 will be juxtaposed to cover edge 29 on cover member 27 along a continuous, single circumferentially-extending, butt seam, generally designated 31. This use of peanut-shaped cover members and a butt seam construction is common to regulation baseballs, as well as cloth-covered balls having protruding looped stitching.

In the improved safety game ball of the present invention, edge binding means 32 is provided on each of cover members 26 and 27. Binding means 32 includes a cloth-edge reinforcing means 33 and a plurality of binding stitches 34 closely proximate to each of the cover edges 28. Additionally, as best seen in FIG. 3 a plurality of seam stitches 36 are provided in the cover with each seam stitch 36 extending from a position 37 inwardly of binding stitches 34 and edge reinforcing means 33 on one of the cover edges to a position 38 inwardly of the binding stitches 34 and cover reinforcing means 33 on the other cover piece.

Figure 4:
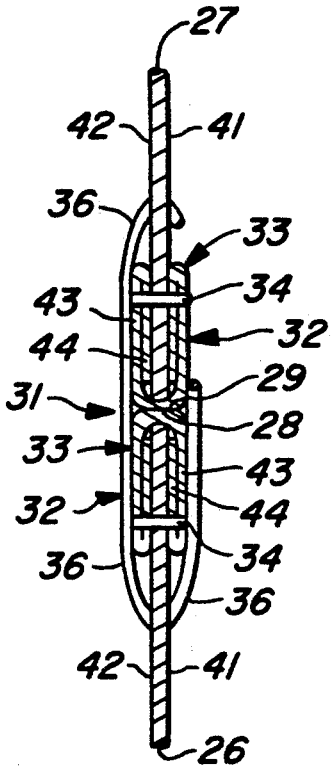
FIG. 4 is an enlarged, fragmentary, end view in cross section taken substantially along the plane of line 4—4 in FIG. 3.

In the preferred form, cloth-edge reinforcing means 32 is provided by a separate cloth strip 33 that extends from an inside surface 41 of each cover member to an outside surface 42 of the cover member. In fact, as shown in FIG. 4, it is preferable that the cover reinforcing edge strip 33 is folded on itself on both the inside and the outside of the cover member to provide two layers 43 and 44 on both inside 41 and outside 42 of the cover members. Binding stitches 34 pass through all four binding strip layers and the cover members 26 and 27 sandwiched therebetween to bind the same together along the edges forming seam 31. In the preferred form, the binding stitches are spaced at between about 6 and 10 stitches per inch and are orientated substantially parallel to cover edges 28 and 29. While folding of the reinforcing cloth strip on itself appears in FIG. 4 to increase the thickness of the seams substantially, in actual construction, the cover members have a thickness dimension which has been measured at about 0.035 inches, and the cloth-reinforced edges will have a thickness dimension of about 0.055 inches, even with two layers of cloth-reinforcing strip on each side of the cover members. These measurements are only approximate since the fabric can be compressed during measurement.

Figure 3:
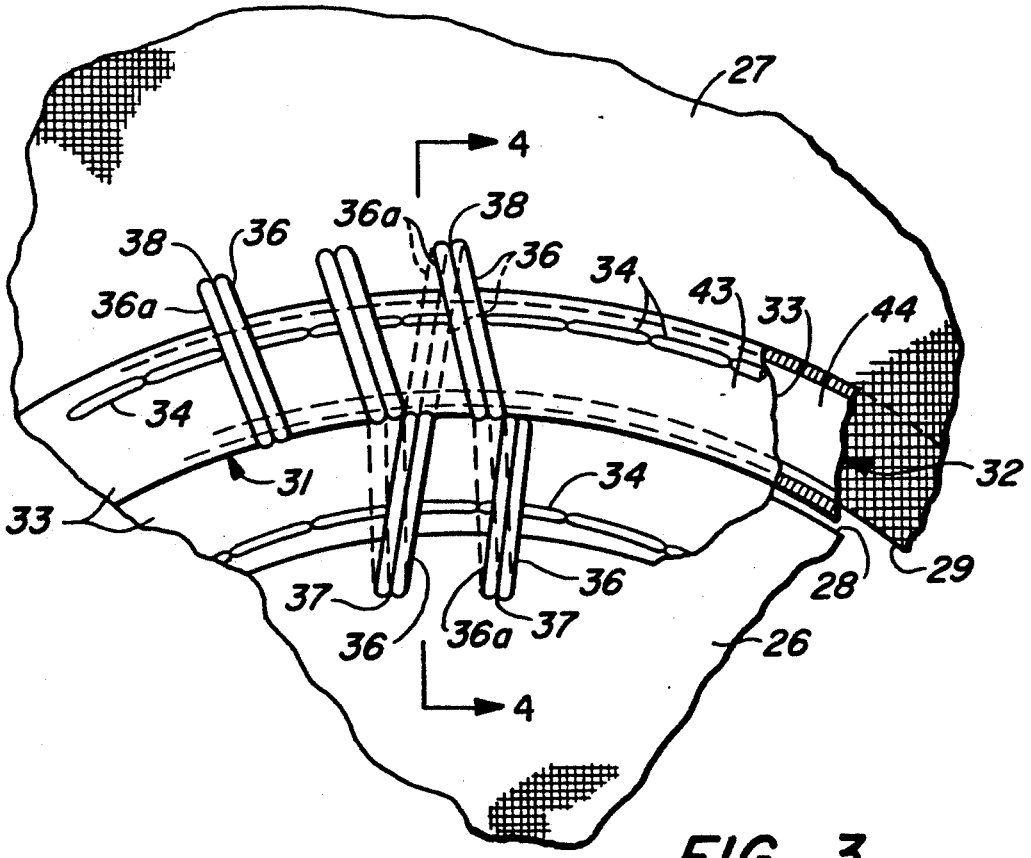
FIG. 3 is an enlarged, fragmentary, side elevation view of the area bounded substantially by line 3—3 in FIG. 1.

As best may be seen in FIGS. 1 and 3, seam stitches 36 preferably are arranged in a herringbone pattern of the type used in conventional baseballs. Moreover, each stitch preferably is comprised of two side-by-side threads, namely, stitch 36 and parallel stitch **36*a*. As will be seen from FIG. 3, each of the stitches 36, 36*a* extends over the outside of one cover edge and then extends under the inside of the other cover edge, whereupon it reemerges outside and extends back to seam 31. The seam stitches preferably extend inwardly to positions 37 and 38 which are about twice the distance inwardly from seam 31 than the location of binding stitches 34**.

EXAMPLE

Safety baseballs were constructed with the following specifications:

Core: Polyurethane, closed-cell foam.

Inner cover: 52 inches of 1 inch cloth adhesive tape wound around the core.

Members Cover: Die cut, 100 denier, 540–560 grams/-30inch wide yard, interlocked, 20 needle weave, knit nylon.

Binding Strip: 17 millimeter wide, 210 denier, knit nylon having a thickness dimension of about 0.005 inches.

Binding at Stitches: 210 denier/3-ply nylon spun thread sewn 8 stitches per inch 3/16 inch from the seam.

Seam Stitches: Herringbone pattern with two parallel stitches, 6–6.5 stitches per inch, cotton 10/4 red thread.

Composite Ball Circumference: 9±¼ inches.

Composite Ball Weight: 110–142±5 grams.

The nylon seam-reinforcing strip was folded upon itself on each side of the knit nylon cover members. The safety balls with relatively flat herringbone butt seams were tested for both impact pressure and durability against protruding, loop-stitched safety baseballs of the same size and weight and against vinyl-covered safety baseballs. The results are shown in Table 1.

TABLE 1

| | DURABILITY (Impacts to Seam Failure) | | IMPACT PRESSURE (lbs./in.$^2$) | |
|---|---|---|---|---|
| | Low Speed (150 mph) | High Speed (220 mph) | 30 mph | 70 mph |
| Cloth-loop-stitched protruding seam | 62 | 22 | 120 | 326 |
| Cloth-herring-bone flat butt seam | 157* | 15 | 120 | 326 |
| Vinyl-herring-bone flat butt seam | 4 | 2 | 199 | 780 |

*These results are based on a statistically insignificant number of balls and it is expected that the failure rate will lower and be closer to that of loop-stitched cloth balls.

As will be seen from Table 1, the durability of the ball constructed with flat herringbone-stitched seams of the present invention is at least as good as the durability of the old looped-type seams. Moreover, the durability is significantly better than the durability of vinyl balls having herringbone-stitched seams. More importantly, the impact pressure at both 30 and 70 miles per hour of the herringbone-stitched seam ball of the present invention has not increased by a measurable amount over the looped-seamed ball, and it remains about one-half that of the vinyl-covered ball.

While the preferred form is to secure a cloth-reinforcing strip 33 to the cover piece edges, safety balls have also been constructed by reinforcing edges 28 and 29 with a cloth-edge reinforcing means 32 provided by folding the cover edges back onto themselves and then stitching them in a folding condition by binding stitches 34. When this form of cover edge reinforcing is employed, the peanut-shaped cover pieces are die-cut to have ¼ inch larger width and length dimensions permitting the edges to be rolled back by ⅛ inch to form the cloth seam reinforcing fold. Game balls constructed using a folded reinforcing seam have substantially the same impact pressure and durability as game balls with separate cloth-reinforcing strips that are attached, but the problems associated with reliably folding the nylon cover pieces have made this form of cloth cover edge reinforcing less desirable than the preferred form of FIGS. 3 and 4.

The herringbone-stitched, cloth-covered game ball of the present invention can be formed in various sizes and weights. For maximum safety, regulation baseball size game balls can have a weight which is somewhat less than the regulation weight.

Similarly, the stitching assembly of the present invention can be employed for nylon-covered regulation softballs, with the result that the softball will have an appearance which very closely resembles that of a regulation softball and an impact pressure which is much less. It is also possible to further reduce the impact pressure by reducing the mass of the safety softball below that of the regulation softball.

From the above description, it will be understood that the method of providing a relatively smooth or flat stitched butt-seamed safety ball of the present invention is comprised of the steps of securing cloth-reinforcing means to cover edges of a cloth cover by binding stitches closely proximate the cover edges, positioning opposed cover edges together in a butt seam, and stitching across the butt seam from a position inwardly of the binding stitches on one side of the seam to position inwardly of the binding stitches on the other side of the seam.

What is claimed:

1. A game ball with a cover having stitched seams comprising:

a substantially spherical core formed of an elastically deformable material;

a flexible cover means mounted around and enclosing said core, said cover means having opposed cover edges juxtaposed together along a circumferentially extending butt seam;

edge binding means including cloth-edge reinforcing means and a plurality of binding stitches closely proximate to each of said edges and securing said reinforcing means to said cover means proximate each of said edges; and a plurality of seam stitches in said cover means with each of said seam stitches extending over the plurality of binding stitches from a position inwardly of said binding stitches and edge reinforcing means on one of said edges to a position inwardly of said binding stitches and said edge reinforcing means on the other of said edges to secure said edges together in a relatively flat stitched butt seam.

2. The safety game ball as defined in claim 1 wherein, said cloth-edge reinforcing means is provided by folding said cover means at said cover edges back onto said cover means; and said binding stitches secure said cover edges in a folded back condition.

3. A safety game ball with a cloth cover having stitched seams comprising:

a substantially spherical core formed of an elastically deformable material;

a flexible cloth-cover means mounted around and enclosing said core, said cover means having opposed cover edges juxtaposed together along a circumferentially extending butt seam;

edge binding means including a cloth strip extending from an inside of said cover means around the cover edge to an outside of said cover means, and a plurality of binding stitches closely proximate to each of said edges and passing through said fabric strip on both sides of said cover means and through said cover means to secure said cloth strip to said cover means proximate each of said edges; and a plurality of seam stitches in said cover means with each of said seam stitches extending over the plurality of binding stitches from a position inwardly of said binding stitches and said cloth strip on one of said edges to a position inwardly of said binding stitches and said cloth strip on the other of said edges to secure said edges together in a relatively flat stitched butt seam.

4. The safety game ball as defined in claim 3, wherein, said cloth strip is folded on itself to provide two layers of said cloth strip on both said inside and said outside of said cover means; and said binding stitches pass through all layers of said fabric strip and said cover means.

5. The safety game ball as defined in claim 3 wherein, said core is formed from a foamed plastic material;

said cover means is provided by two cover members formed from a knit fabric material; and said seam stitches are provided by stitches in a herringbone pattern.

6. The safety game ball as defined in claim 5 wherein, said ball has a circumference substantially equal to the circumference of a regulation baseball; and said seam stitches are provided by side-by-side pairs of stitches in a herringbone pattern.

7. The safety game ball as defined in claim 6 wherein, said ball has a weight substantially equal to the weight of a regulation baseball; and said core is sufficiently deformable to produce an impact pressure of said game ball substantially less than the impact pressure of a regulation baseball.

8. The safety game ball as defined in claim 7 wherein, said ball has an impact pressure less than about 250 pounds per square inch on impact at about 30 miles per hour.

9. The safety game ball as defined in claim 5 wherein, said ball has a circumference of about 11 inches and a weight substantially equal to the weight of a regulation 11 inch circumference softball.

10. The safety game ball as defined in claim 5 wherein, said ball has a circumference of about 12 inches and a weight substantially equal to the weight of a regulation 12 inch circumference softball.

11. The safety game ball as defined in claim 5 wherein, said ball has a circumference of about 16 inches and a weight substantially equal to the weight of a regulation 16 inch circumference softball.

12. A safety baseball comprising:

a substantially spherical core formed of an elastically deformable plastic material;

a flexible cloth cover mounted over and enclosing said core, said cover being provided by two peanut-shaped knit fabric cover members each having cover edges positioned in juxtaposed relation to be joined together in a continuous butt seam;

said core and cover having a combined diameter and weight not significantly larger than the diameter and weight of a regulation baseball, and said core and cover being sufficiently elastically deformable to have an impact pressure substantially less than the impact pressure of a regulation baseball;

a cloth-reinforcing strip secured to each of said fabric members along said cover edges by a plurality of binding stitches extending substantially parallel and closely proximate to said cover edges; and a plurality of seam stitches arranged in a herringbone pattern across said butt seam with each of said seam stitches extending over the plurality of binding stitches through each of said fabric members from a position inwardly of said binding stitches on one of said fabric members to a position inwardly of said binding stitches on the other of said fabric members to secure said cover edges together in a stitched butt seam.

13. The safety baseball as defined in claim 12 wherein, said cloth-reinforcing strip is provided by a separate strip of cloth positioned on both sides of each fabric member to sandwich said fabric member therebetween; and said binding stitches pass through all layers of said cloth-reinforcing strip and said fabric member to secure said cloth-reinforcing strip to said fabric member.

14. The safety baseball as defined in claim 13 wherein, said core is a foamed polyurethane material;

said fabric members are formed from knit nylon fabric;

said cloth-reinforcing strip is a knit nylon strip; and said seam stitches are provided by side-by-side pairs of stitches in a herringbone pattern.

15. The safety baseball as defined in claim 14 wherein, said binding stitches are provided by at least 6 stitches per inch along said seam.

16. The safety baseball as defined in claim 15 wherein, said binding stitches are positioned at about one-half of the distance of said seam stitches from said cover edges.

17. A safety softball comprising:

a substantially spherical core formed of an elastically deformable plastic material;

a flexible cloth cover mounted over and enclosing said core, said cover being provided by two peanut-shaped knit fabric members each having cover edges positioned in juxtaposed relation to be joined together in a continuous butt seam;

said core and cover having a combined diameter and weight not significantly larger than the diameter and weight of a regulation softball, and said core and cover being sufficiently elastically deformable to have an impact pressure substantially less than the impact pressure of a regulation softball;

a cloth-reinforcing strip secured to said fabric members along said cover edges on each of said fabric members by a plurality of binding stitches extending substantially parallel and closely proximate to said cover edges; and a plurality of seam stitches arranged in a herringbone pattern across said butt seam with each of said seam stitches extending over the plurality of binding stitches through each of said fabric members from a position inwardly of said binding stitches on one of said fabric members to a position inwardly of said binding stitches on the other of said fabric members to secure said cover edges together in a stitched butt seam.

18. A method of providing a relatively smooth stitched butt seam on a safety ball having a core formed of a material capable of substantial elastic deformation on impact and a cloth cover mounted over said core, said method comprising the steps of:

securing cloth-reinforcing means to cover edges of said cloth cover by binding stitches closely proximate said cover edges;

positioning opposed cover edges together in a butt seam; and stitching over the plurality of binding stitches and across said butt seam from a position inwardly of said binding stitches on one side of said seam to a position inwardly of said binding stitches on another side of said seam.

* * * * *